US011148421B2

(12) United States Patent
Sugiura

(10) Patent No.: US 11,148,421 B2
(45) Date of Patent: Oct. 19, 2021

(54) LIQUID DISCHARGE HEAD

(71) Applicant: Brother Kogyo Kabushiki Kaisha, Nagoya (JP)

(72) Inventor: Keita Sugiura, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/878,052

(22) Filed: May 19, 2020

(65) Prior Publication Data

US 2020/0384770 A1 Dec. 10, 2020

(30) Foreign Application Priority Data

Jun. 5, 2019 (JP) ..... JP2019-105537

(51) Int. Cl.
*B41J 2/14* (2006.01)

(52) U.S. Cl.
CPC .. *B41J 2/14233* (2013.01); *B41J 2002/14306* (2013.01)

(58) Field of Classification Search
None
See application file for complete search history.

(56) References Cited

U.S. PATENT DOCUMENTS

2007/0109373 A1* 5/2007 Kojima ..... B41J 2/055 347/94
2014/0078225 A1 3/2014 Park et al.
2014/0292954 A1 10/2014 Hirabayashi et al.

FOREIGN PATENT DOCUMENTS

JP 2014-061696 A 4/2014
JP 2014-188837 A 10/2014

* cited by examiner

*Primary Examiner* — Erica S Lin
(74) *Attorney, Agent, or Firm* — Banner & Witcoff, Ltd.

(57) ABSTRACT

A liquid discharge head includes: individual channels arranged in a first direction; and first and second common channels each extending in the first direction. An opening of the first common channel and an opening of the second common channel are arranged at the same side with respect to the individual channels in the first direction. Each of the individual channels includes: a first communicating channel and a second communicating channel communicating with the first common channel, and a third communicating channel communicating with the second common channel. A midpoint in the first direction between a first connection position where the first common channel is connected to the first communicating channel and a second connection position where the first common channel is connected to the second communicating channel is positioned in a range of a third connection position where the second common channel is connected to the third communicating channel.

8 Claims, 8 Drawing Sheets

LIQUID DISCHARGE HEAD

CROSS REFERENCE TO RELATED APPLICATION

The present application claims priority from Japanese Patent Application No. 2019-105537 filed on Jun. 5, 2019, the disclosure of which is incorporated herein by reference in its entirety.

BACKGROUND

Field of the Invention

The present disclosure relates to a liquid discharge head including common channels.

Description of the Related Art

There is known a liquid discharge head including individual channels. In this liquid discharge head, each individual channel includes two circulation individual channels (first communicating channel and second communicating channel) communicating with a circulation common channel (first common channel), and an individual supply channel (third communicating channel) communicating with an ink supply channel (second common channel).

SUMMARY

In the liquid discharge head, an opening of the circulation common channel and an opening of the ink supply channel may be positioned at the same side with respect to the individual channels in a nozzle arrangement direction, and a midpoint in the nozzle arrangement direction between a position where the circulation common channel is connected to one of the two circulation individual channels and a position where the circulation common channel is connected to the other of the two circulation individual channels may not be positioned in a range of a position where the ink supply channel is connected to the individual supply channel. In this case, a pressure balance in the individual channels is lost owing to the difference in pressures acting on the respective connection positions, which may cause excessive pressure acting on the nozzles during ink (liquid) circulation and fluctuation in ink discharge from the nozzles.

An object of the present disclosure is to provide a liquid discharge head capable of inhibiting excessive pressure that may otherwise act on nozzles during liquid circulation.

According to an aspect of the present disclosure, there is provided a liquid discharge head, including: a plurality of individual channels arranged in a first direction; and a first common channel and a second common channel extending in the first direction, wherein an opening of the first common channel and an opening of the second common channel are arranged at the same side with respect to the individual channels in the first direction, each of the individual channels includes: a first communicating channel and a second communicating channel communicating with the first common channel; and a third communicating channel communicating with the second common channel, and a midpoint in the first direction between a first connection position where the first common channel is connected to the first communicating channel and a second connection position where the first common channel is connected to the second communicating channel is positioned in a range of a third connection position where the second common channel is connected to the third communicating channel.

DESCRIPTION OF THE EMBODIMENTS

First Embodiment

Figure 1:
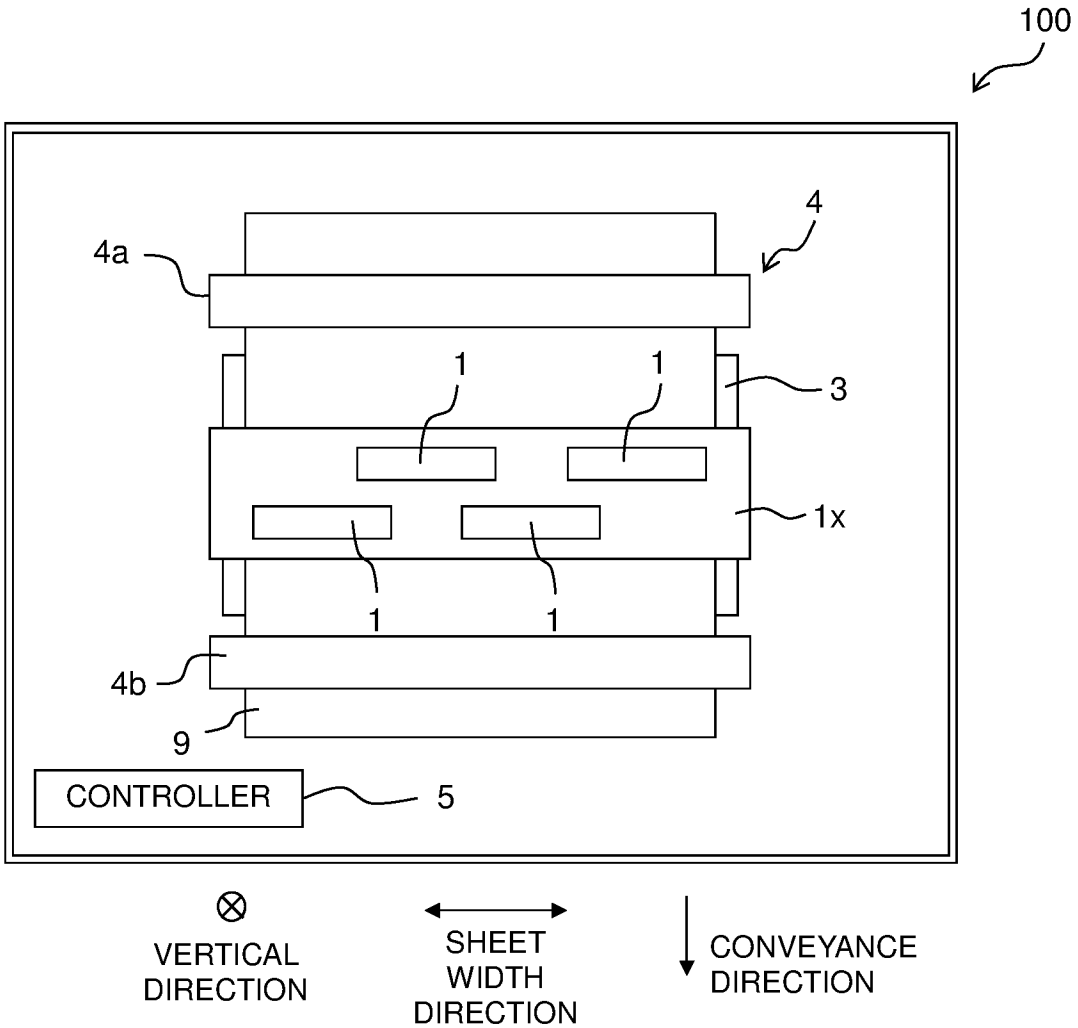
FIG. 1 is a plan view of a printer including heads according to the first embodiment of the present disclosure.

Referring to FIG. 1, a schematic configuration of a printer 100 including heads 1 according to the first embodiment of the present disclosure is explained.

The printer 100 includes a head unit 1*x* including four heads 1, a platen 3, a conveyer 4, and a controller 5.

A sheet P is placed on an upper surface of the platen 3.

The conveyer 4 has two roller pairs 4*a* and 4*b* disposed to interpose the platen 3 therebetween in a conveyance direction. When a conveyance motor (not depicted) is driven by the control of the controller 5, the roller pairs 4*a* and 4*b* nipping the sheet 9 rotate and the sheet P is conveyed in the conveyance direction.

The head unit 1*x* is long in a sheet width direction (direction orthogonal to the conveyance direction and a vertical direction). The head unit 1*x* is a line-type head unit in which ink is discharged from nozzles 21 (see FIGS. 2 to 4) on the sheet 9 with the head unit 1*x* being fixed or secured to a body of the printer 100. The four heads 1, which are long in the sheet width direction, are arranged zigzag in the sheet width direction.

The controller 5 includes a Read Only Memory (ROM), a Random Access Memory (RAM), and an Application Specific Integrated Circuit (ASIC). The ASIC executes recording processing and the like in accordance with programs stored in the ROM. In the recording processing, the controller 5 controls a driver IC (not depicted) and the conveyance motor (not depicted) of each head 1 based on a recording instruction (including image data) input from an external apparatus, such as a PC, to record an image on the sheet 9.

Figure 2:
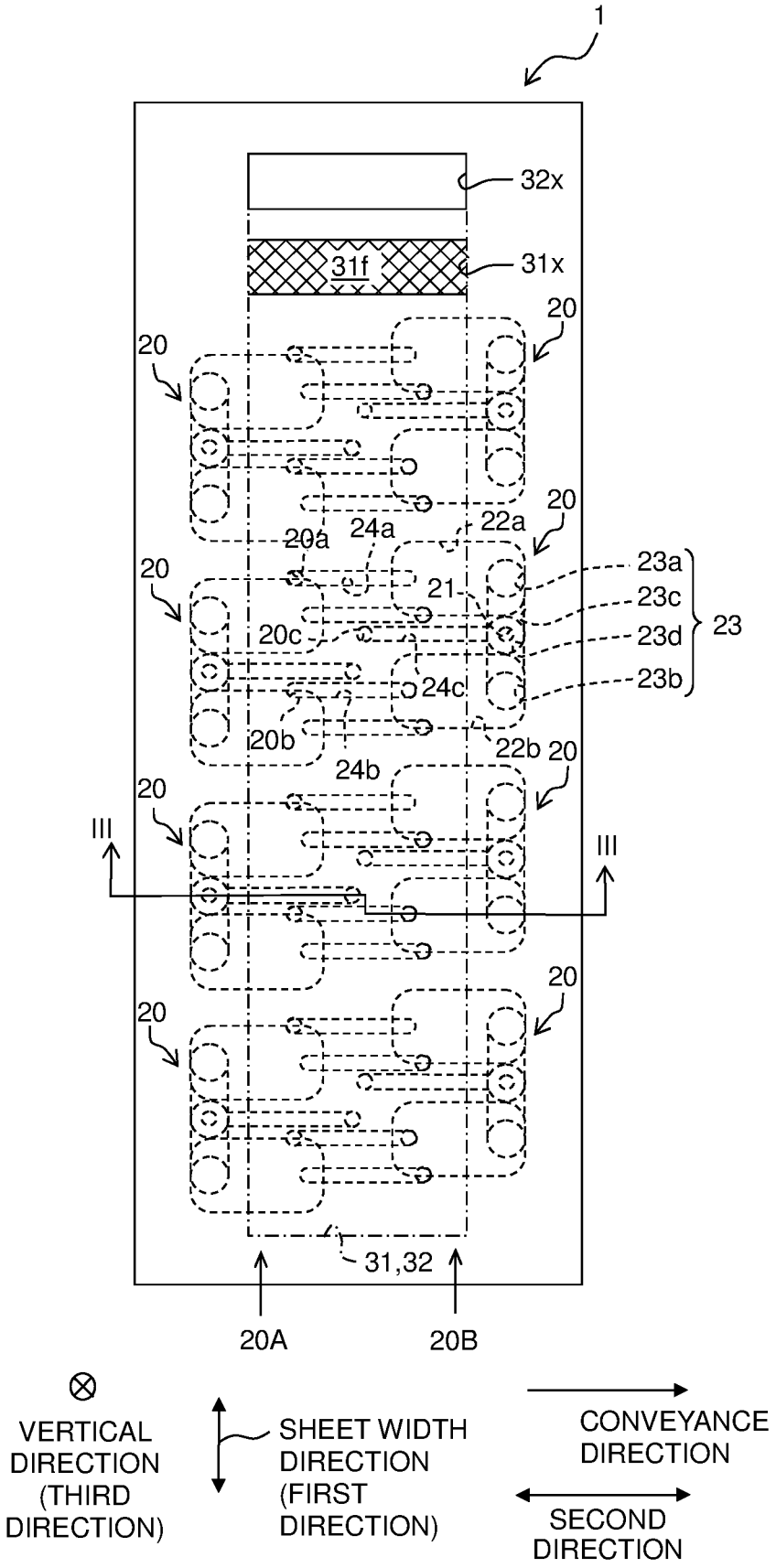
FIG. 2 is a plan view of the head.
Figure 3:
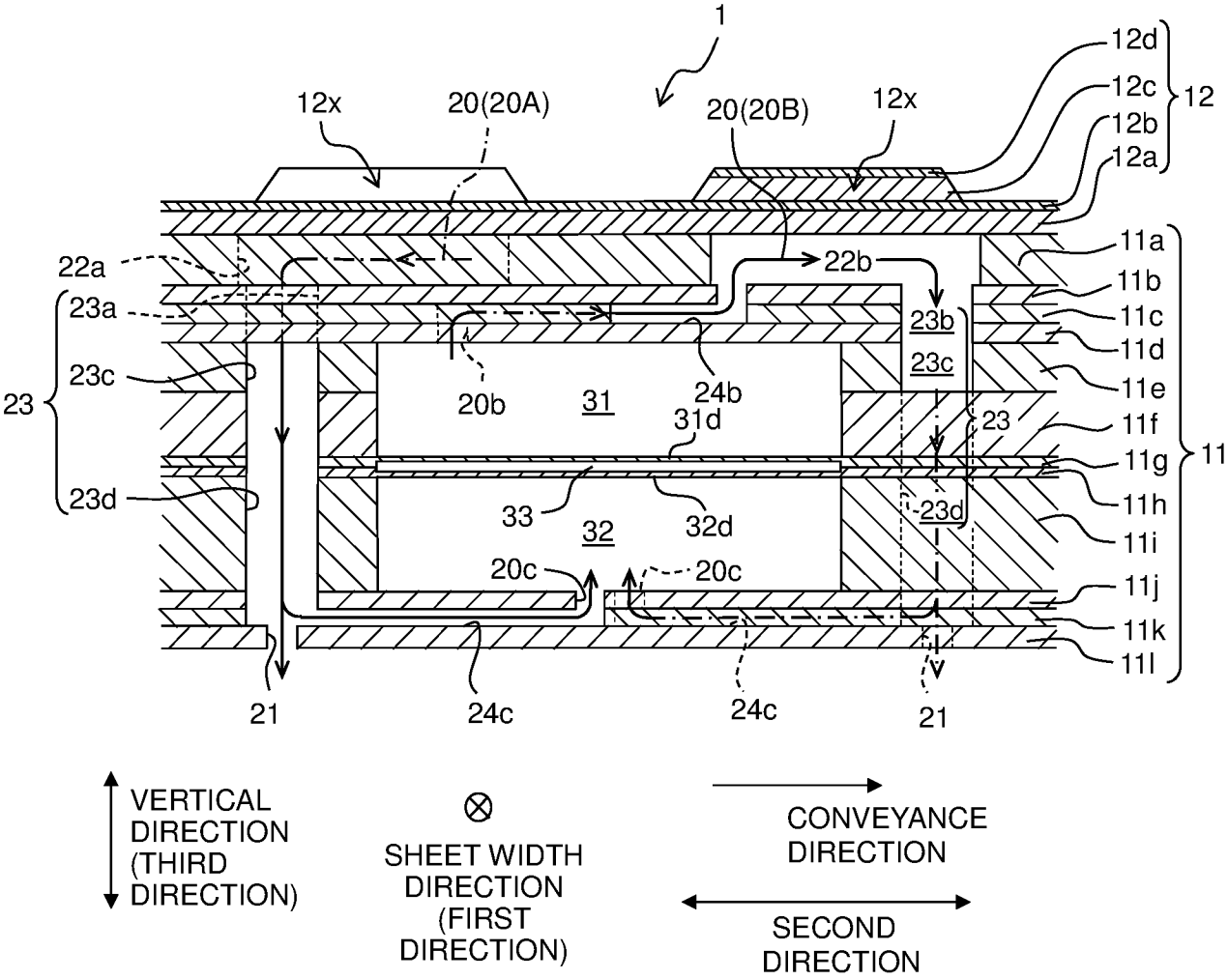
FIG. 3 is a cross-sectional view taken along a line in FIG. 2.
Figure 4:
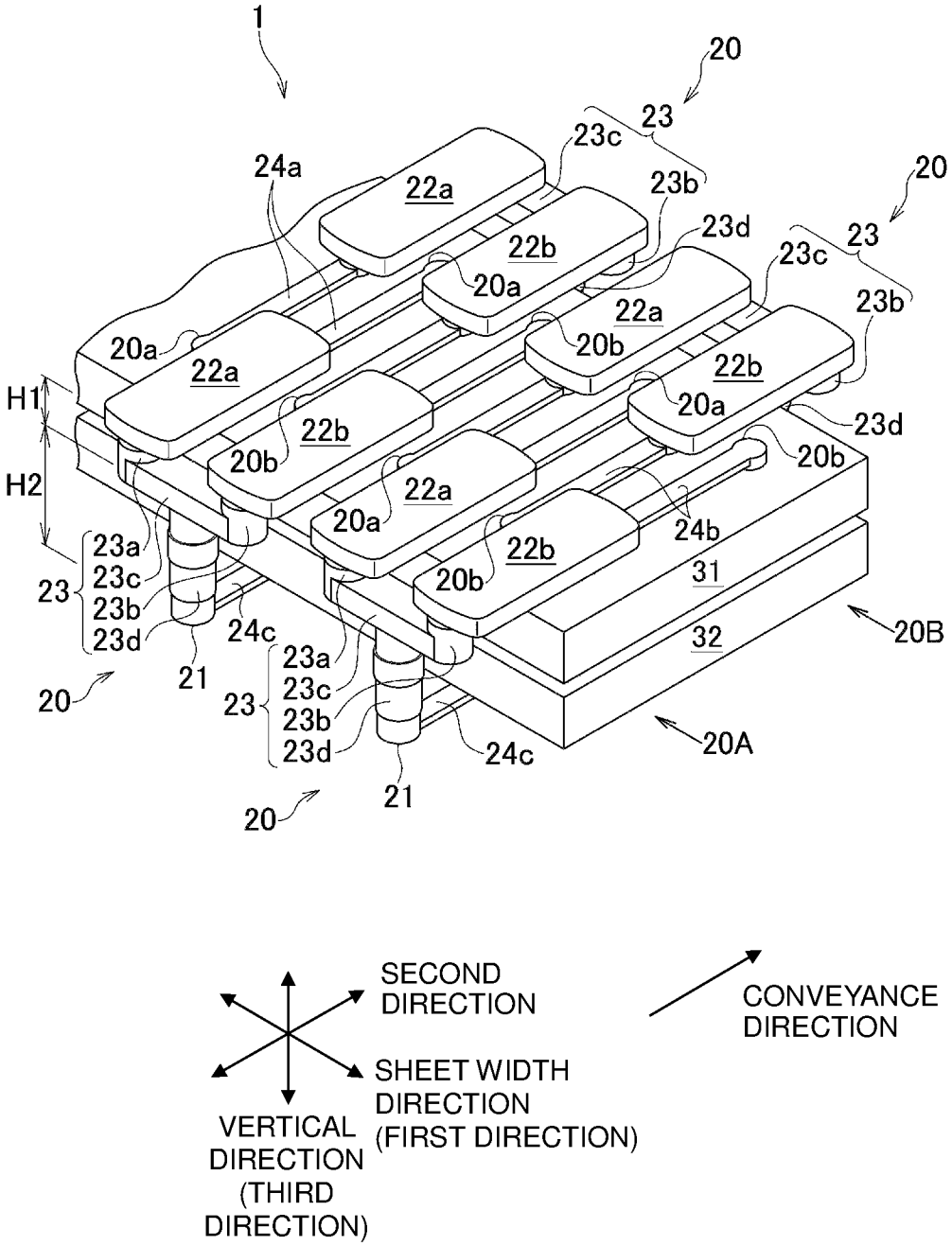
FIG. 4 is a perspective view depicting part of channels formed in the head.

Referring to FIGS. 2 to 4, a configuration of the head 1 is explained.

As depicted in FIG. 3, the head 1 includes a channel substrate 11 and an actuator substrate 12.

The channel substrate 11 includes twelve plates 11*a* to 11*l* that are stacked on top of each other in the vertical direction. The plates 11*a* to 11*l* are adhered to each other. The plates 11*a* to 11*l* are formed having through holes forming channels. The channels include individual channels 20, a supply channel 31, and a return channel 32.

As depicted in FIG. 2, the individual channels 20 are arranged zigzag in the sheet width direction (first direction)

to form a first individual channel group 20A and a second individual channel group 20B. Each of the individual channel groups 20A and 20B is formed by the individual channels 20 arranged in the first direction. The first individual channel group 20A and the second individual channel group 20B are arranged in a direction parallel to the conveyance direction (second direction: a width direction of the supply channel 31 and the return channel 32, and a direction orthogonal to the first direction).

The supply channel 31 and the return channel 32 extend in the first direction. The supply channel 31 corresponds to a "first common channel" of the present disclosure. The return channel 32 corresponds to a "second common channel" of the present disclosure. In this embodiment, the supply channel 31 and the return channel 32 are arranged in the vertical direction (third direction: a height direction of the supply channel 31 and the return channel 32, a direction orthogonal to the first direction and the second direction). The supply channel 31 overlaps in the vertical direction with the return channel 32. The supply channel 31 and the return channel 32 have substantially the same length (length in the first direction), substantially the same width (length in the second direction), and substantially the same height (length in the third direction).

One end in the first direction (lower end in FIG. 2) of the supply channel 31 is coupled to one end in the first direction (lower end in FIG. 2) of the return channel 32.

The supply channel 31 communicates with a subtank (not depicted) via a supply opening 31*x* provided in the other end in the first direction (upper end in FIG. 2). The return channel 32 communicates with the subtank (not depicted) via a return opening 32*x* provided in the other end in the first direction (upper end in FIG. 2). The supply opening 31*x* corresponds to an "opening of the first common channel" of the present disclosure. The return opening 32*x* corresponds to an "opening of the second common channel" of the present disclosure.

The supply opening 31*x* and the return opening 32*x* are positioned on the same side with respect to the individual channels 20 in the first direction. The supply opening 31*x* and the return opening 32*x* are arranged in the first direction. The supply opening 31*x* is positioned between the individual channels 20 and the return opening 32*x* in the first direction. Namely, an interval in the first direction between the return opening 32*x* and the individual channels 20 is larger than an interval in the first direction between the supply opening 31*x* and the individual channels 20.

The supply opening 31*x* and the return opening 32*x* are opened in an upper surface of the channel substrate 11. The supply opening 31*x* is formed having a filter 31*f*, and the return opening 32*x* is formed having no filter.

The subtank communicates with a main tank containing ink, and the subtank contains ink supplied from the main tank. Driving a pump (not depicted) through the control by the controller 5 supplies ink in the subtank into the supply channel 31 through the supply opening 31*x*. The ink flowing into the supply channel 31 is supplied to the individual channels 20 while moving through the supply channel 31 from the other end in the first direction (upper end in FIG. 2) toward the one end in the first direction (lower end in FIG. 2). The ink reaching the one end in the first direction (lower end in FIG. 2) of the supply channel 31 and the ink flowing out of the individual channels 20 flow into the return channel 32. The ink flowing into the return channel 32 moves through the return channel 32 from the one end (lower end in FIG. 2) toward the other end (upper end in FIG. 2) in the first direction, and returns to the subtank via the return opening 32*x*.

As depicted in FIG. 3, the supply channel 31 is formed by through holes formed in the plates 11*e* and 11*f*. The return channel 32 is formed by a through hole formed in the plate 11*i*. A damper chamber 33 is provided between the supply channel 31 and the return channel 32 in the third direction. The damper chamber 33 is formed by a recess formed in the plate 11*g* and a recess formed in the plate 11*h*. A bottom portion of the recess formed in the plate 11*g* functions as a dumper film 31*d* of the supply channel 31. A bottom portion of the recess formed in the plate 11*h* functions as a dumper film 32*d* of the return channel 32.

As depicted in FIG. 2, each individual channel 20 includes one nozzle 21, two pressure chambers (first pressure chamber 22*a* and second pressure chamber 22*b*), one connection channel 23, two inflow channels (first inflow channel 24*a* and second inflow channel 24*b*), and one outflow channel 24*c*.

As depicted in FIG. 3, the nozzle 21 is formed by a through hole formed in the plate 11*l*. The nozzle 21 is opened in a lower surface of the channel substrate 11. The first pressure chamber 22*a* and the second pressure chamber 22*b* are formed by through holes formed in the plate 11*a*. The first pressure chamber 22*a* and the second pressure chamber 22*b* are opened in the upper surface of the channel substrate 11.

As depicted in FIG. 2, the first pressure chamber 22*a* and the second pressure chamber 22*b* have the same shape and dimension. The first pressure chamber 22*a* and the second pressure chamber 22*b* are arranged in the first direction. In a plane parallel to the first direction and the second direction (plane orthogonal to the third direction), each of the pressure chambers 22*a* and 22*b* has a substantially rectangular shape that is long in the second direction. One end in the second direction of the first pressure chamber 22*a* is connected to the connection channel 23, and the other end in the second direction of the first pressure chamber 22*a* is connected to the first inflow channel 24*a*. One end in the second direction of the second pressure chamber 22*b* is connected to the connection channel 23, and the other end in the second direction of the second pressure chamber 22*b* is connected to the second inflow channel 24*b*.

The connection channel 23 connects the nozzle 21 and the first pressure chamber 22*a*, and connects the nozzle 21 and the second pressure chamber 22*b*. Specifically, as depicted in FIG. 4, the connection channel 23 includes a first connection portion 23*a* connected to the first pressure chamber 22*a*, a second connection portion 23*b* connected to the second pressure chamber 22*b*, a coupling portion 23*c* coupling the first connection portion 23*a* with the second connection portion 23*b*, and an extending portion 23*d* extending downward from the coupling portion 23*c* and having the nozzle 21 at a lower end thereof.

In this embodiment, each of the connection portions 23*a* and 23*b* is a cylindrical channel extending downward from the one end in the second direction of each of the pressure chambers 22*a* and 22*b*. As depicted in FIG. 3, each of the connection portions 23*a* and 23*b* is formed by through holes formed in the plates 11*b* to 11*d*. The present disclosure, however, is not limited thereto. For example, the coupling portion 23*c* may be positioned immediately under the pressure chambers 22*a* and 22*b* (i e, channels, such as the cylindrical channels, are not positioned between the coupling portion 23*c* and the pressure chambers 22*a*, 22*b*), and each of the connection portions 23*a* and 23*b* may be formed by an interference between each of the pressure chambers 22*a*, 22*b* and the coupling portion 23*c* (an opening formed in a lower surface of each of the pressure chambers 22*a* and 22*b*).

As depicted in FIG. 3, the coupling portion 23*c* is formed by the through hole formed in the plate 11*e*. The coupling portion 23*c* extends in the first direction along a plane orthogonal to the third direction.

As depicted in FIG. 3, the extending portion 23*d* is formed by through holes formed in the plates 11*f* to 11*k*. The extending portion 23*d* extends in the third direction. The nozzle 21 is positioned on the lower side of the coupling portion 23*c* (at the opposite side of the first pressure chamber 22*a* and the second pressure chamber 22*b*) in the third direction.

In this embodiment, as depicted in FIG. 4, a length H1 in the third direction ranging from the first pressure chamber 22*a* and the second pressure chamber 22*b* to the coupling portion 23*c* is less than a length H2 in the third direction ranging from the coupling portion 23*c* to the nozzle 21. Namely, the coupling portion 23*c* is positioned in an upper portion of an area occupied by the connection channel 23 (a side close to the pressure chambers 22*a* and 22*b*).

As depicted in FIG. 2, each of the pressure chambers 22*a* and 22*b* belonging to the first individual channel group 20A includes a portion overlapping in the third direction with the supply channel 31 and the return channel 32, and a portion not overlapping in the third direction with the supply channel 31 and the return channel 32 and positioned at one side in the second direction with respect to the supply channel 31 and the return channel 32. Each of the pressure chambers 22 and 22*b* belonging to the second individual channel group 20B includes a portion overlapping in the third direction with the supply channel 31 and the return channel 32, and a portion not overlapping in the third direction with the supply channel 31 and the return channel 32 and positioned at the other side in the second direction with respect to the supply channel 31 and the return channel 32.

The connection channels 23 and the nozzles 21 belonging to the first individual channel group 20A are positioned at the one side in the second direction with respect to the supply channel 31 and the return channel 32. The connection channels 23 and the nozzles 21 belonging to the second individual channel group 20B are positioned at the other side in the second direction with respect to the supply channel 31 and the return channel 32.

Each first inflow channel 24*a* has one end connected to the other end in the second direction of the first pressure chamber 22*a* (an opposite end of the one end connected to the connection channel 23) and the other end connected to the supply channel 31 (inlet 20*a* of the individual channel 20). Each second inflow channel 24*b* has one end connected to the other end in the second direction of the second pressure chamber 22*b* (an opposite end of the one end connected to the connection channel 23) and the other end connected to the supply channel 31 (inlet 20*b* of the individual channel 20). The supply channel 31 communicates with the first pressure chamber 22*a* and the second pressure chamber 22*b* via the first inflow channel 24*a* and the second inflow channel 24*b*, respectively.

As depicted in FIG. 3, each of the inflow channels 24*a* and 24*b* is formed by through holes formed in the plates 11*b* to 11*d*.

As depicted in FIG. 3, the outflow channel 24*c* is formed by through holes formed in the plates 11*j* and 11*k*. The outflow channel 24*c* has one end connected to a lower end of the extending portion 23*d* and the other end connected to the return channel 32 (outlet 20*c* of the individual channel 20). The return channel 32 communicates with the connection channel 23 via the outflow channel 24*c*.

Each of the inflow channels 24*a*, 24*b* and the outflow channel 24*c* has a width smaller than a width (length in the first direction) of each of the pressure chambers 22*a* and 22*b*. Each of the inflow channels 24*a*, 24*b* and the outflow channel 24*c* functions as a throttle.

The first inflow channel 24*a* corresponds to a "first communicating channel" of the present disclosure, the second inflow channel 24*b* corresponds to a "second communicating channel" of the present disclosure, and the outflow channel 24*c* corresponds to a "third communicating channel" of the present disclosure. The inlet 20*a* is a connection opening that connects the supply channel 31 and the first inflow channel 24*a*, and a position of the inlet 20*a* corresponds to a "first connection position" of the present disclosure. The inlet 20*b* is a connection opening that connects the supply channel 31 and the second inflow channel 24*b*, and a position of the inflow 20*b* corresponds to a "second connection position" of the present disclosure. The outlet 20*c* is a connection opening that connects the return channel 32 and the outflow channel 24*c*, and a position of the outlet 20*c* corresponds to a "third connection position" of the present disclosure.

In this embodiment, as depicted in FIG. 2, the inflow channels 24*a*, 24*b* and the outflow channel 24*c* extend in the second direction. The inflow channels 24*a*, 24*b* and the outflow channel 24*c* are arranged in the first direction at regular intervals. The outlet 20*c* is provided at a center portion between the inlet 20*a* and the inlet 20*b* in the first direction. Namely, in the first direction, a midpoint between the position of the inlet 20*a* (first connection position) and the position of the inlet 20*b* (second connection position) is in a range of the position of the outlet 20*c* (third connection position).

The inlets 20*a* and 20*b* are positioned between the center portion and one end in the second direction of the supply channel 31. The inlets 20*a* and 20*b* are in the same position in the second direction. The outlet 20*c* is positioned at a center portion in the second direction of the return channel 32. The position in the second direction of the inlet 20*c* is different from that of the inlets 20*a* and 20*b*.

The inlets 20*a* and 20*b* are provided in an upper surface of the supply channel 31 (see FIG. 3). The inlets 20*a* and 20*b* are in the same position in the third direction. The outlet 20*c* is provided in a lower surface of the return channel 32. The outlet 20*c* is positioned below the inlets 20*a* and 20*b*.

The ink supplied from the supply channel 31 to each individual channel 20 passes through the first inflow channel 24*a* and the second inflow channel 24*b* and flows into the first pressure chamber 22*a* and the second pressure chamber 22*b*, respectively. Then, the ink moves through the respective pressure chambers 22*a* and 22*b* substantially horizontally and flows into the connection channel 23. The ink flowing into the connection channel 23 passes through the first connection portion 23*a* and the second connection portion 23*b*, reaches the coupling portion 23*c*, and moves downward through the extending portion 23*d*. Part of the ink is discharged from the nozzle 21, and remaining part of the ink flows into the return channel 32 through the outflow channel 24*c*.

Circulating ink between the subtank and the channel substrate 11 as described above achieves the discharge of air and inhibits the increase in viscosity of ink not only in the supply channel 31 and the return channel 32 formed in the channel substrate 11 but also in the individual channels 20.

When ink contains a settling component (component that may settle, such as pigment), the component is agitated or stirred to inhibit the settling.

As depicted in FIG. 3, the actuator substrate 12 includes a vibration plate 12*a*, a common electrode 12*b*, piezoelectric bodies 12*c*, and individual electrodes 12*d* in that order from the bottom.

The vibration plate 12*a* and the common electrode 12*b* are disposed on the upper surface of the channel substrate 11 (upper surface of the plate 11*a*). The vibration plate 12*a* and the common electrode 12*b* cover all the pressure chambers 22*a* and 22*b* formed in the channel substrate 11. The piezoelectric bodies 12*c* and the individual electrodes 12*d* are provided for the respective pressure chambers 22*a* and 22*b*. The piezoelectric bodies 12*c* and the individual electrodes 12*d* overlap in the third direction with the pressure chambers 22*a* and 22*b*.

The common electrode 12*b* and the individual electrodes 12*d* are electrically connected to the driver IC (not depicted). The driver IC maintains the electrical potential of the common electrode 12*b* at a ground potential, and changes the electrical potential of the individual electrode 12*d*. Specifically, the driver IC generates a driving signal based on a control signal from the controller 5 and applies the driving signal to the individual electrode 12*d*. This changes the electrical potential of the individual electrode 12*d* between a predefined driving potential and the ground potential. The change in electrical potential of the individual electrode 12*d* deforms part (actuator 12*x*) of the vibration plate 12*a* and the piezoelectric body 12*c* interposed between the individual electrode 12*d* and each of the pressure chambers 22*a* and 22*b* so that the actuator 12*x* becomes convex toward each of the pressure chambers 22*a* and 22*b*. This changes the volume of each of the pressure chambers 22*a* and 22*b*, applies pressure to the ink in each of the pressure chambers 22*a* and 22*b*, and thereby discharges ink from the nozzle 21. The actuator substrate 12 includes multiple actuators 12*x* corresponding to the respective pressure chambers 22*a* and 22*b*.

As described above, in this embodiment, the supply channel 31 and the return channel 32 extend in the first direction, and the supply opening 31*x* and the return opening 32*x* are provided at the same side in the first direction with respect to the individual channels 20 (see FIG. 2). In this configuration, the pressure in the supply channel 31 may differ from that in the return channel 32 in the first direction (ink flowing direction). In the configuration according to this embodiment, however, pressure can act on the nozzles 21 symmetrically from the supply channel 31 and the return channel 32. In each individual channel 20, the pressure acting on the inlet 20*a* positioned at an upstream side from the supply channel 31 is larger than the pressure acting on the inlet 20*b* positioned at a downstream side from the supply channel 31. Thus, the pressure acting on the inlet 20*a* may be different from that acting on the inlet 20*b*. In this embodiment, the pressure acting on the outlet 20*c* (pressure of which positivity and negativity are different from those of the pressure acting on each inlet 20*a*) cancels or offsets the difference between the pressure acting on the inlet 20*a* and the pressure acting on the inlet 20*b* by providing the outlet 20*c* at the center portion in the first direction between the inlets 20*a* and 20*b* (i.e., by positioning the midpoint between the position of the inlet 20*a* (first connection position) and the position of the inlet 20*b* (second connection position) in a range of the position of the outlet 20*c* (third connection position) in the first direction). In this configuration, the balance between the pressure acting on the nozzle 21 from the outlet 20*c* and the pressure acting on the nozzle 21 from the inlets 20*a* and 20*b* is maintained, inhibiting excessive pressure that may otherwise act on the nozzle 21 during ink circulation.

Second Embodiment

Subsequently, referring to FIG. 5, a head 201 according to the second embodiment of the present disclosure is explained.

In the first embodiment (FIG. 2), the first inflow channel 24*a* and the second inflow channel 24*b* of each individual channel 20 extend in the second direction. In this embodiment (FIG. 5), a first inflow channel 224*a* and a second inflow channel 224*b* of each individual channel 220 extend in an oblique direction intersecting with the first direction and the second direction.

In the first embodiment (FIG. 2), the inlet 20*a* and the outlet 20*c* and the inlet 20*b* are arranged in the first direction at regular intervals. In this embodiment (FIG. 5), an inlet 220*a* and an inlet 220*b* are formed by one opening. The inflow channels 224*a* and 224*b* branch off from the one opening and extend in the oblique direction.

The outlet 20*c* is positioned below the inlets 220 and 220*b*. The outlet 20*c* overlaps in the third direction with the inlets 220*a* and 220*b*.

The position of the inlet 220*a* (first connection position) is coincident with the position of the inlet 220*b* (second connection position) in the first direction, the second direction, and the third direction. The position of the outlet 20*c* (third connection position) is the coincident with the position of the inlet 220*a* (first connection position) and the position of the inlet 220*b* (second connection position) in the first direction and the second direction.

As described above, although the configuration of the inflow channels in the second embodiment is different from that in the first embodiment, the effects similar to the first embodiment can be obtained by satisfying the condition similar to the first embodiment (the condition in which the midpoint between the position of the inlet 220*a* (first connection position) and the position of the inlet 220*b* (second connection position) is in a range of the position of the outlet 20*c* (third connection position) in the first direction).

Figure 5:
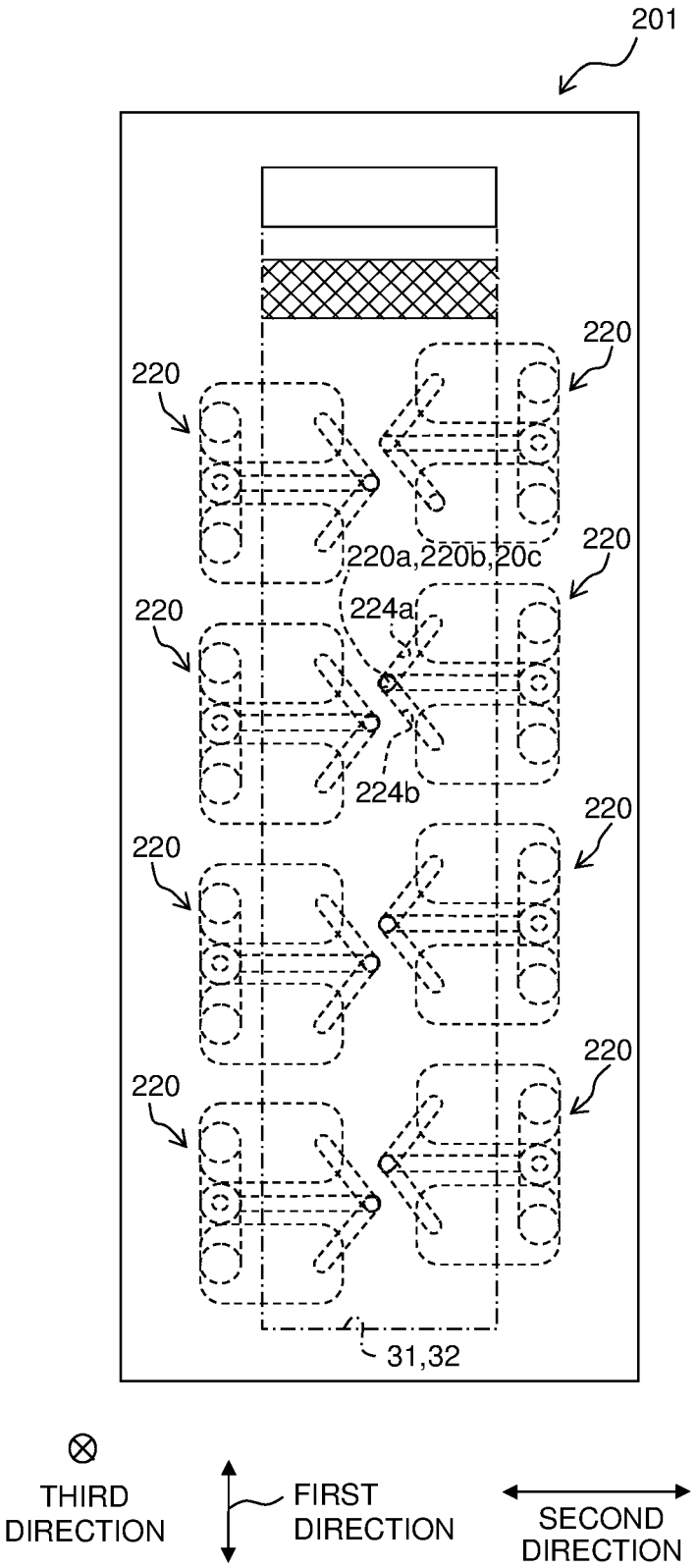
FIG. 5 is a plan view of a head according to the second embodiment of the present disclosure.

Further, in this embodiment, the position of the inlet 220*a* (first connection position) is coincident with the position of the inlet 220*b* (second connection position) in the first direction (see FIG. 5). When the position of the inlet 220*a* (first connection position) is not coincident with the position of the inlet 220*b* (second connection position) in the first direction, the difference in pressure in the first direction in the supply channel 31 may cause the difference between the pressure acting on the inlet 220*a* and the pressure acting on the inlet 220*b*. In this case, the flowing of ink different from the desired flowing is caused in the individual channel 220 (e.g., the flowing of ink from the inlet 220*a* to the inlet 220*b* is caused), which may make ink discharge unstable. In order to solve this problem, in the second embodiment, the position of the inlet 220*a* (first connection position) is coincident with the position of the inlet 220*b* (second connection position) in the first direction. This is thus not likely to cause the difference between the pressure acting on the inlet 220*a* and the pressure acting on the inlet 220*b*, making ink discharge stable.

The pressure in the supply channel 31 may differ not only in the first direction but also in the second direction. For example, in the supply channel 31, the flow rate (flow velocity) is likely to be high at a center portion in the second direction (pressure is large), and the flow rate is likely to be low at ends in the second direction (pressure is small). In view of the above, in second embodiment, the position of the inlet 220*a* (first connection position) is coincident with the position of the inlet 220*b* (second connection position) not only in the first direction but also in the second direction (see FIG. 5). This configuration reliably inhibits the difference between the pressure acting on the inlet 220*a* and the pressure acting on the inlet 220*b*, which makes ink discharge stable.

The pressure in the supply channel 31 may differ not only in the first direction and the second direction but also in the third direction. For example, in the supply channel 31, the flow rate is likely to be high at a center portion in the third direction (pressure is large), and the flow rate is likely to be low at ends in the third direction (pressure is small). In view of the above, in the second embodiment, the position of the inlet 220*a* (first connection position) is coincident with the position of the inlet 220*b* (second connection position) not only in the first direction and the second direction but also in the third direction. This configuration reliably inhibits the difference between the pressure acting on the inlet 220*a* and the pressure acting on the inlet 220*b*, which makes ink discharge stable. Further, in this configuration, the inlets 220*a* and 220*b* can be formed by one opening, resulting in a simple configuration.

Similar to the pressure in the supply channel 31, the pressure in the return channel 32 may differ not only in the first direction but also in the second direction. For example, in the return channel 32, the flow rate is likely to be high at a center portion in the second direction (pressure is large), and the flow rate is likely to be low at ends in the second direction (pressure is small). In view of the above, in the second embodiment, the position of the outlet 20*c* (third connection position) is coincident with the position of the inlet 220*a* (first connection position) and the position of the inlet 220*b* (second connection position) in the second direction (see FIG. 5). In this configuration, the pressure acting on the outlet 20*c* reliably cancels or offsets the difference between the pressure acting on the inlet 220*a* and the pressure acting on the inlet 220*b*, thus maintaining the pressure balance in the individual channel 220.

The wording a certain connection position "is coincident with" another connection position means a situation where the openings forming the respective connection positions at least partially overlap with each other, and thus the openings are not required to overlap with each other completely.

Third Embodiment

Figure 6:
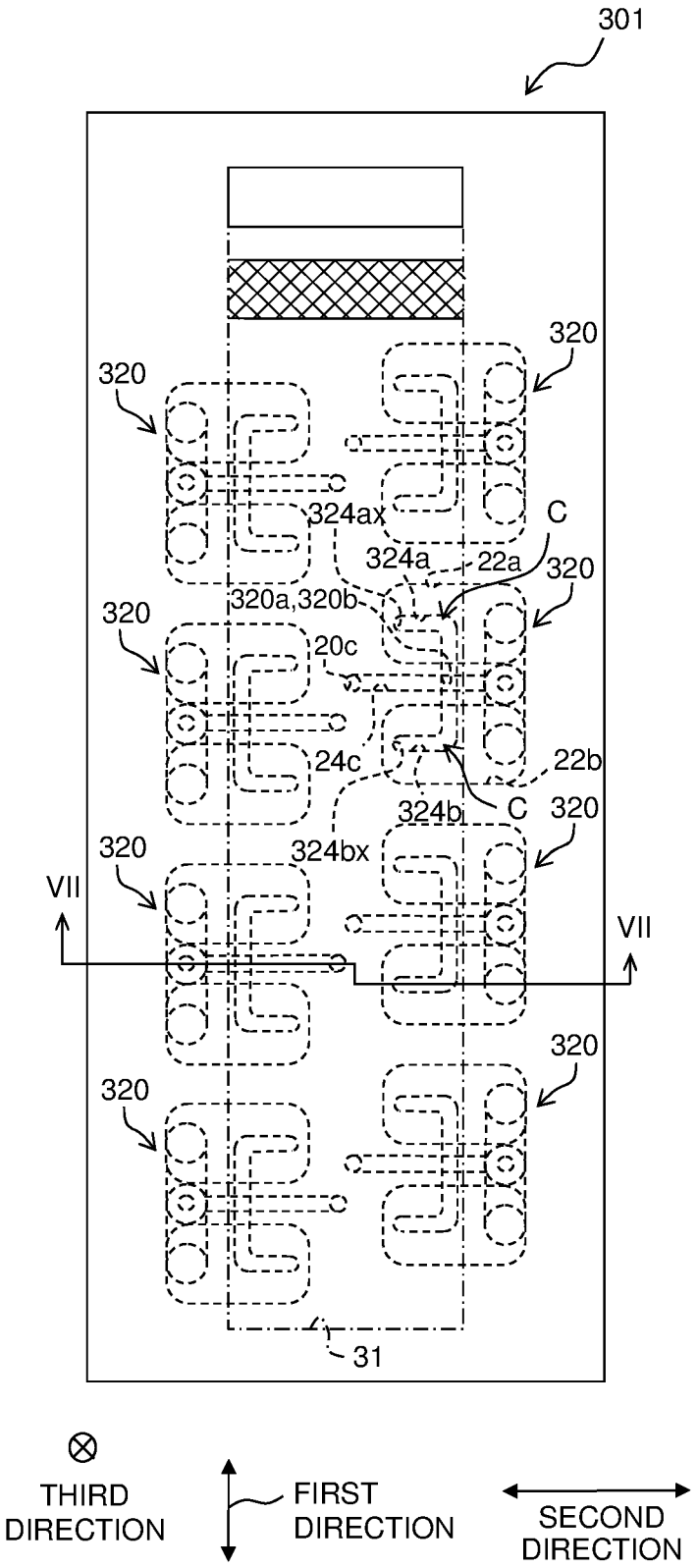
FIG. 6 is a plan view of a head according to the third embodiment of the present disclosure.
Figure 7:
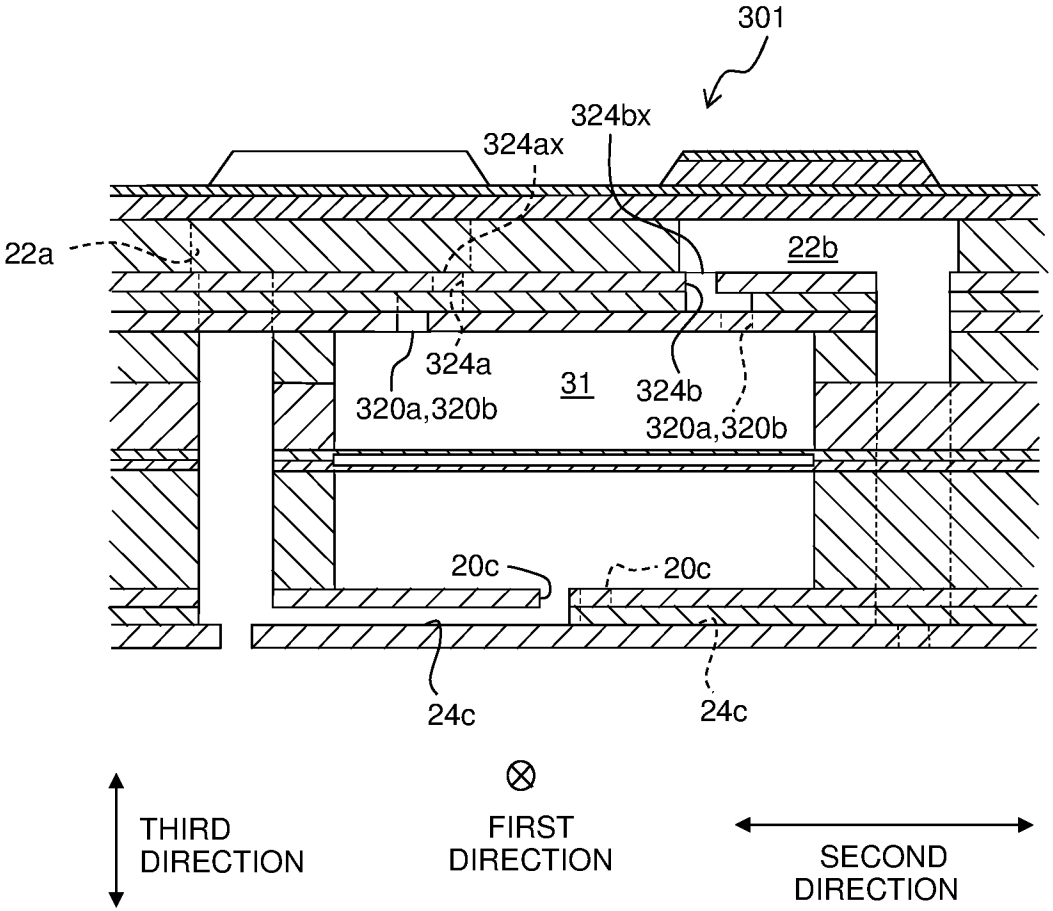
FIG. 7 is a cross-sectional view taken along a line VII-VII in FIG. 6.

Referring to FIGS. 6 and 7, a head 301 according to the third embodiment of the present disclosure is explained.

In the first embodiment (FIG. 2), the first inflow channel 24*a* and the second inflow channel 24*b* of each individual channel 20 extends in the second direction. In this embodiment (FIG. 6), a first inflow channel 324*a* and a second inflow channel 324*b* of each individual channel 320 are curved to have a L shape in a plane parallel to the first direction and the second direction (plane orthogonal to the third direction).

In the first embodiment (FIG. 2), the inlet 20*a* and the outlet 20*c* and the inlet 20*b* are arranged in the first direction at regular intervals. In this embodiment (FIG. 6), similar to the inlets 220*a* and 220*b* (FIG. 5) of the second embodiment, an inlet 320*a* and an inlet 320*b* are formed by one opening. The inflow channels 324*a* and 324*b* branch off from the one opening, extend toward one side and the other side in the first direction, and further extends in the second direction.

The first inflow channel 324*a* has one end 324*ax* connected to the first pressure chamber 22*a* and the other end (inlet 320*a* of the individual channel 320) connected to the supply channel 31. The second inflow channel 324*b* has one end 324*bx* connected to the second pressure chamber 22*b* and the other end (inlet 320*b* of the individual channel 320) connected to the supply channel 31.

Each of the inflow channels 324*a* and 324*b* has a first portion extending from the one end 324*ax*, 324*bx* in the second direction and a second portion extending from a front end of the first portion in the first direction to reach the other end (inlet 320*a*, 320*b*). A curved portion C is provided between the first portion and the second portion. Each of the inflow channels 324*a* and 324*b* corresponds to a "curved channel" of the present disclosure.

The first inflow channel 324*a* is placed in an area of the first pressure chamber 22*a* in the second direction. The second inflow channel 324*b* is placed in an area of the second pressure chamber 22*b* in the second direction. Namely, the inflow channels 324*a* and 324*b* are positioned in the areas of the respective pressure chambers 22*a* and 22*b* in the second direction.

As depicted in FIG. 7, the outlet 20*c* is positioned below the inlets 320*a* and 320*b*. The outlet 20*c* and inlets 320*a* and 320*b* are arranged in the second direction as depicted in FIG. 6. The inlets 320*a* and 320*b* overlap in the third direction with the outflow channel 24*c* as depicted in FIG. 7.

As described above, although the configuration of the inflow channels in the third embodiment is different from that in the first direction, the effects similar to the first embodiment can be obtained by satisfying the condition similar to the first embodiment (the condition in which the midpoint between the position of the inlet 320*a* (first connection position) and the position of the inlet 320*b* (second connection position) is in a range of the position of the outlet 20*c* (third connection position) in the first direction).

Further, in this embodiment, the inflow channels 324*a* and 324*b* are curved (see FIG. 6), which efficiently increases the resistance of the inflow channels 324*a* and 324*b*. The flow rate in the inflow channels 324*a* and 324*b* thus increases, which makes the ink supply to each individual channel 320 via the inflow channels 324*a* and 324*b* smooth.

The inflow channels 324*a* and 324*b* are placed in the areas of the pressure chambers 22*a* and 22*b* in the second direction (see FIG. 6). In this case, compared to a case where the inflow channels 324*a* and 324*b* are placed outside the areas of the pressure chambers 22*a* and 22*b* in the second direction, it is possible to downsize the individual channel 320 in the second direction and to downsize the head 301 in the second direction.

Fourth Embodiment

Figure 8:
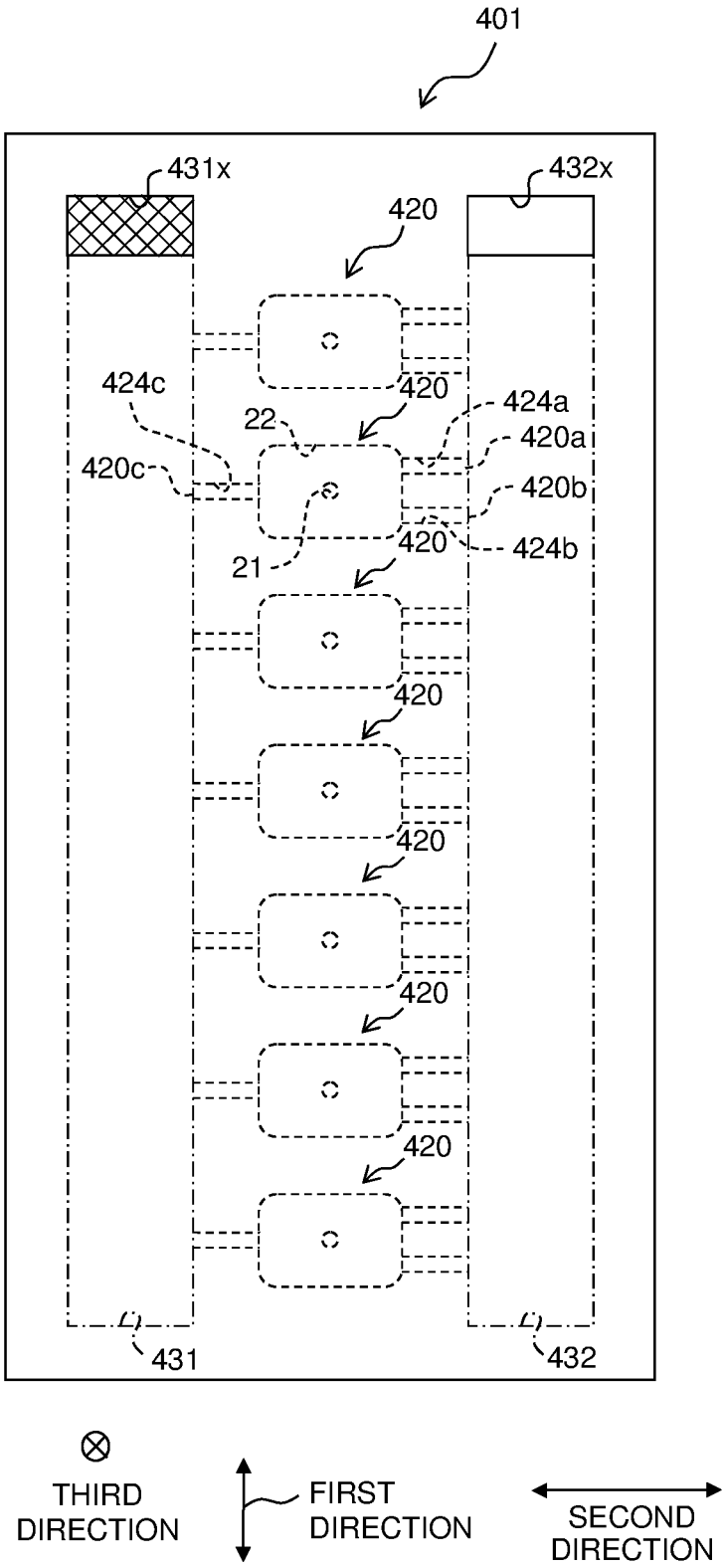
FIG. 8 is a plan view of a head according to the fourth embodiment of the present disclosure.

Referring to FIG. 8, a head 401 according to the fourth embodiment of the present disclosure is explained.

In the first embodiment (FIG. 2), the supply channel 31 and the return channel 32 are arranged in the third direction. The one end in the first direction of the supply channel 31 is coupled to the one end in the first direction of the return channel 32. In this embodiment (FIG. 8), a supply channel 431 and a return channel 432 are arranged in the second direction. One end in the first direction of the supply channel 431 is not coupled to one end in the first direction of the return channel 432.

The supply channel 431 and the return channel 432 extend in the first direction. The supply channel 431 corresponds to the "second common channel" of the present disclosure. The return channel 432 corresponds to the "first common channel" of the present disclosure. The supply channel 431 and the return channel 432 have the same length (length in the first direction), the same width (length in the second direction), and the same height (length in the third direction).

A supply opening 431*x* and a return opening 432*x* are positioned on the same side with respect to individual channels 420 in the first direction. The supply opening 431*x* and the return opening 432*x* are arranged in the second direction.

The individual channels 420 are arranged in a row in the first direction. The individual channels 420 are positioned between the supply channel 431 and the return channel 432 in the second direction. Each individual channel 420 includes one nozzle 21, one pressure chamber 22, two outflow channels (first outflow channel 424*a* and second outflow channel 424*b*), and one inflow channel 424*c*.

The nozzles 21 are positioned immediately below the pressure chambers 22.

The inflow channel 424*c* has one end connected to one end in the second direction of the pressure chamber 22 and the other end (inlet 420*c* of the individual channel 420) connected to the supply channel 431. The supply channel 431 communicates with each pressure chamber 22 via the inflow channel 424*c*.

The first outflow channel 424*a* has one end connected to the other end in the second direction of the pressure chamber 22 and the other end (outlet 420*a* of the individual channel 420) connected to the return channel 432. The second outflow channel 424*b* has one end connected to the other end in the second direction of the pressure chamber 22 and the other end (outlet 420*b* of the individual channel 420) connected to the return channel 432. The return channel 432 communicates with each pressure chamber 22 via the first outflow channel 424*a* and the second outflow channel 424*b*.

The first outflow channel 424*a* corresponds to the "first communicating channel" of the present disclosure, and the second outflow channel 424*b* corresponds to the "second communicating channel" of the present disclosure, and the inflow channel 424*c* corresponds to the "third communicating channel" of the present disclosure. The outlet 420*a* is a connection opening between the return channel 432 and the first outflow channel 424*a*. The position of the outlet 420*a* corresponds to the "first connection position" of the present disclosure. The outlet 420*b* is a connection opening between the return channel 432 and the second outflow channel 424*b*. The position of the outlet 420*b* corresponds to the "second connection position" of the present disclosure. The inlet 420*c* is a connection opening between the supply channel 431 and the inflow channel 424*c*. The position of the inlet 420*c* corresponds to the "third connection position" of the present disclosure.

In this embodiment, the outflow channels 424*a* and 424*b* and the inflow channel 424*c* extend in the second direction. The outflow channels 424*a* and 424*b* and the inflow channel 424*c* are arranged in the first direction at regular intervals. In the first direction, the inlet 420*c* is placed at a center position between the outlet 420*a* and the outlet 420*b*. Namely, in the first direction, a midpoint between the position of the outlet 420*a* (first connection position) and the position of the outlet 420*b* (second connection position) is in a range of the position of the inlet 420*c* (third connection position).

As described above, although the channel configuration in the third embodiment is different from that in the first embodiment, the effects similar to the first embodiment can be obtained by satisfying the condition similar to the first embodiment (the condition in which the midpoint between the position of the outlet 420*a* (first connection position) and the position of the outlet 420*b* (second connection position) is in a range of the position of the inlet 420*c* (third connection position) in the first direction).

Modified Example

The embodiments of the present disclosure are explained above. The present disclosure, however, is not limited to the above embodiments. Various changes or modifications in design may be made without departing from the claims.

The second embodiment (FIG. 5) may adopt a configuration, in which the position of the inlet 220*a* is coincident with the position of the inlet 220*b* in the first direction but the position of the inlet 220*a* is not coincident with the position of the inlet 220*b* in the second direction (i.e., the inlets 220*a* and 220*b* are arranged in the second direction) and a configuration, in which the position of the inlet 220*a* is coincident with the position of the inlet 220*b* in the first direction but the position of the inlet 220*a* is not coincident with the position of the inlet 220*b* in the third direction (i.e., the inlets 220*a* and 220*b* are arranged in the third direction).

The first common channel and the second common channel may have different widths (lengths in the second direction) and different heights (lengths in the third direction).

In the third embodiment, the inflow channels 324*a* and 324*b* are curved. Instead of curving the inflow channels 324*a* and 324*b*, the outflow channel 24*c* may be curved. In this case, it is possible to efficiently increase the resistance of the outflow channel 24*c*. This makes the flow rate in the outflow channel 24*c* high, thus discharging air from the individual channel 320 smoothly.

The filter may be provided for the return channel No filter may be provided for the supply channel.

No damper may be provided for the first and second common channels.

The position of each nozzle is not limited to the center portion in a longitudinal direction of the coupling portion. Each nozzle may be positioned in any position in the longitudinal direction of the coupling portion (e.g., one end or the other end in the longitudinal direction of the coupling portion).

The number of nozzles belonging to each individual channel is one in the above embodiment. The number of nozzles belonging to each individual channel may be two or more.

The liquid discharge head is not limited to the line-type head. The liquid discharge head may be a serial type head in which liquid is discharged from nozzles on a medium (an object to which liquid is to be discharged) during its movement in a scanning direction parallel to the sheet width direction.

The medium is not limited to the sheet or paper, and may be a cloth, a substrate, and the like.

The liquid discharged from the nozzles is not limited to the ink, and may be any liquid (e.g., a treatment liquid that agglutinates or precipitates constituents of ink).

The present disclosure is applicable to facsimiles, copy machines, multifunction peripherals, and the like without limited to printers. The present disclosure is also applicable to a liquid discharge apparatus used for any other application than the image recording (e.g., a liquid discharge apparatus that forms an electroconductive pattern by discharging an electroconductive liquid on a substrate).

What is claimed is:

1. A liquid discharge head, comprising:

a plurality of individual channels arranged in a first direction; and a first common channel and a second common channel extending in the first direction, wherein an opening of the first common channel and an opening of the second common channel are arranged at the same side with respect to the individual channels in the first direction, each of the individual channels communicates with the first common channel and the second common channel, each of the individual channels includes:

a first communicating channel communicating with the first common channel;

a second communicating channel communicating with the first common channel; and a third communicating channel communicating with the second common channel, and a midpoint in the first direction between a first connection position where the first common channel is connected to the first communicating channel and a second connection position where the first common channel is connected to the second communicating channel is positioned in a range of a third connection position where the second common channel is connected to the third communicating channel.

2. The liquid discharge head according to claim 1, wherein the first connection position is coincident with the second connection position in the first direction.

3. The liquid discharge head according to claim 2, wherein the first connection position is coincident with the second connection position in a second direction that is a width direction of the first common channel and the second common channel.

4. The liquid discharge head according to claim 3, wherein the first connection position is coincident with the second connection position in a third direction that is a height direction of the first common channel and the second common channel.

5. The liquid discharge head according to claim 3, wherein the first common channel and the second common channel overlap with each other in a third direction that is a height direction of the first common channel and the second common channel, a length in the second direction of the first common channel is identical to a length in the second direction of the second common channel, a length in the third direction of the first common channel is identical to a length in the third direction of the second common channel, and the third connection position is coincident with the first connection position and the second connection position in the second direction.

6. The liquid discharge head according to claim 1, wherein at least any of the first communicating channel, the second communicating channel, and the third communicating channel is a curved channel, which has a curved portion extending along a plane parallel to the first direction and a second direction and curving in the plane, the second direction being a width direction of the first common channel and the second common channel.

7. The liquid discharge head according to claim 6, wherein each of the individual channels includes a nozzle and a pressure chamber communicating with the nozzle and the curved channel, and the curved channel is disposed in an area of the pressure chamber in the second direction.

8. The liquid discharge head according to claim 1, wherein each of the individual channels includes a single nozzle.

* * * * *